US005557262A

United States Patent [19]

Tice

[11] Patent Number: 5,557,262

[45] Date of Patent: Sep. 17, 1996

[54] FIRE ALARM SYSTEM WITH DIFFERENT TYPES OF SENSORS AND DYNAMIC SYSTEM PARAMETERS

[75] Inventor: Lee D. Tice, Bartlett, Ill.

[73] Assignee: Pittway Corporation, Chicago, Ill.

[21] Appl. No.: 479,957

[22] Filed: Jun. 7, 1995

[51] Int. Cl.[6] ..... G08B 17/00; G08B 17/06; G08B 17/10

[52] U.S. Cl. ..... 340/587; 340/522; 340/529; 340/577; 340/628

[58] Field of Search ..... 340/587, 522, 340/579, 577, 628, 629, 630, 529

[56] References Cited

U.S. PATENT DOCUMENTS

| | | | |
|---|---|---|---|
| 4,149,159 | 4/1979 | Dätwyler et al. | 340/522 |
| 4,195,286 | 3/1980 | Galvin | 340/587 |
| 4,388,616 | 6/1983 | Machida | 340/578 |
| 4,514,720 | 4/1985 | Oberstein et al. | 340/511 |
| 4,525,700 | 6/1985 | Kimura et al. | 340/518 |
| 4,556,873 | 12/1985 | Yamada et al. | 340/630 |
| 4,639,598 | 1/1987 | Kern et al. | 250/339 |
| 4,644,331 | 2/1987 | Matsushita et al. | 340/587 |
| 4,692,750 | 9/1987 | Murakami et al. | 340/588 |
| 4,697,172 | 9/1987 | Kimura | 340/587 |
| 4,727,359 | 2/1988 | Yuchi et al. | 340/518 |
| 4,749,986 | 6/1988 | Otani et al. | 340/587 |
| 4,785,283 | 11/1988 | Yuchi | 340/501 |
| 4,796,205 | 1/1989 | Ishii et al. | 364/550 |
| 4,803,469 | 2/1989 | Matsushita | 340/577 |
| 4,871,999 | 10/1989 | Ishii et al. | 340/587 |
| 4,916,432 | 4/1990 | Tice et al. | 340/505 |
| 4,922,230 | 5/1990 | Ohtani et al. | 340/577 |
| 4,924,417 | 5/1990 | Yuasa | 364/550 |
| 5,168,262 | 12/1992 | Okayama | 340/523 |
| 5,267,180 | 11/1993 | Okayama | 364/571.03 |
| 5,280,272 | 1/1994 | Nagashima et al. | 340/630 |
| 5,281,951 | 1/1994 | Okahama | 340/511 |

*Primary Examiner*—Glen Swann

*Attorney, Agent, or Firm*—Dressler, Goldsmith, Shore & Milnamow

[57] ABSTRACT

A fire alarm system utilizes outputs from different types of fire sensors, such as photoelectric smoke sensors or ionization type smoke sensors and combines those outputs by subtraction so as to establish a delay interval during which one or both of the sensor output values must exceed a predetermined threshold value to cause the system to go into an alarm condition. Prior to subtracting the outputs from one another, each of the outputs can be raised to a predetermined exponential value so as to emphasize the effects of larger sensor output values. Where the two types of fire sensors each are generating outputs indicative of a fire condition, the calculated delays will be relatively short. In instances where only one of the two sensors is generating an output indicative of a fire condition, the calculated delay will be longer, so as to inhibit false alarms.

24 Claims, 3 Drawing Sheets

FIRE ALARM SYSTEM WITH DIFFERENT TYPES OF SENSORS AND DYNAMIC SYSTEM PARAMETERS

FIELD OF THE INVENTION

The invention pertains to systems and methods for the detection of ambient conditions. More particularly, the invention pertains to such systems and methods which incorporate different types of fire sensors for the purpose of reducing nuisance alarms which detect actual fire conditions.

BACKGROUND OF THE INVENTION

Fire detection systems have been recognized as being useful and valuable in residential and commercial buildings in providing an early alarm in the event of a developing fire. From the point of view of responding to a fire condition and potentially evacuating some or all of the associated building, the earliest possible detection of the fire condition is preferred. One such system is illustrated in Tice et al., U.S. Pat. No. 4,916,432 assigned to the assignee of the present application and incorporated herein by reference.

Counterbalancing the need for early detection, is a need to minimize or eliminate, if possible, false or nuisance alarms. Such alarms occur as a result of electrical or other types of environmental noise present in buildings wherein the alarm systems are installed.

Additionally, it is known that different types of smoke detectors respond, in part, based on the type of smoke. For example, ionization-type detectors have a faster response to smoke from flaming fires than do photoelectric-type detectors. On the other hand, photoelectric-type smoke detectors have a faster response to smoke from smoldering fires.

Another parameter that can affect the number of nuisance alarms is detector sensitivity. A detector with a high sensitivity is more likely to produce nuisance alarms than one set to a low sensitivity. On the other hand, a detector with high sensitivity setting has the advantage of producing an alarm condition sooner than a detector with a lower sensitivity setting in the presence of an actual fire.

Thus, there continues to be a need for multiple sensor detection systems which take into account the characteristics of different types of potential or actual fires so as to minimize nuisance alarms yet provide a rapid response to developing fire conditions. Preferably, such systems could be manufactured and installed at a cost comparable to known systems.

SUMMARY OF THE INVENTION

A multiple sensor detection system includes a first sensor-type for purposes of detecting the presence of a selected ambient condition, such as potential or actual fire condition, as well as a second sensor-type for detecting a potential or actual fire condition. An output from the first sensor-type, is combined with an output from the second-type of sensor to establish a delay in going into alarm. An important benefit of minimizing false alarms is achieved thereby.

Representative sensors of the first type include ionization-type sensors, temperature sensors or the like. Representative sensors of the second type include photoelectric-type sensors.

In yet another aspect of the invention, the apparatus can include a control element for the purpose of processing outputs from the two types of sensors. The outputs can for example, be subtracted for purposes of establishing a delay value. Prior to subtraction, a sensitivity parameter for each type of sensor can be combined with a respective sensor output value. For example, each sensor output value can be divided by a respective sensitivity parameter. Alternatively, the sensor outputs can each be raised to an exponential value to increase the effect, partially, of larger sensor output values.

In yet another aspect of the invention the sensor outputs can be processed locally or can be transmitted to and processed at a remote alarm control unit. The sensor-types can be located together in the same housing or spaced apart in different housings.

These and other aspects and attributes of the present invention will be discussed with reference to the following drawings and accompanying specification.

DETAILED DESCRIPTION OF THE PREFERRED EMBODIMENTS

Figure 1:
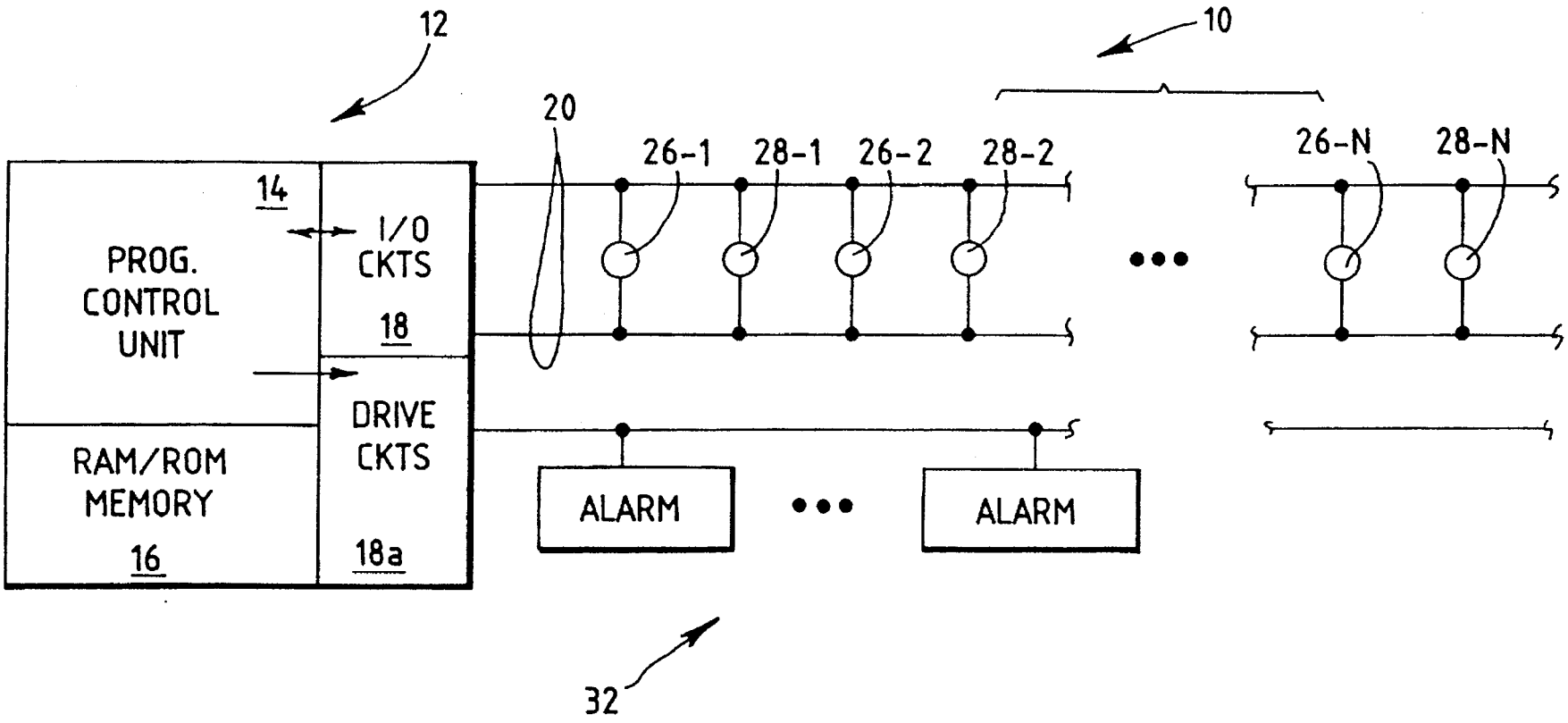
FIG. 1 is an overall block diagram of the system in accordance with the present invention.

While this invention can be embodied in different structures and methods, there are shown in the drawing, and will be described herein in detail, specific embodiments thereof with the understanding that the present disclosure is to be considered as an exemplification of the principles of the invention and is not intended to limit the invention to the specific embodiments illustrated.

With respect to FIG. 1, a system 10 incorporates a control unit 12. The control unit 12 includes a programmable processor 14 which can have coupled thereto memories such as Random Access Memory (RAM) or Read Only Memory (ROM) 16 and input/output circuitry 18. The memory 16 can be used to store a control program as well as current data pertaining to the system 10.

A communication link 20 provides bi-directional communications between input/output circuitry 18 and a plurality of fire condition detectors. While the communication link 20 is illustrated in FIG. 1 as a multiple conductor cable, it will be understood that other forms of communication could be used.

The members of the plurality of detectors could be in radio frequency communication with the unit 12. Alternately, the length 20 could be implemented as a bi-directional optical link. The exact structure of the link 20 is not a limitation of the present invention.

The members of the plurality of detectors include a first type of detector of a fire condition, which for example, could be ionization-type smoke detectors 26-1, 26-2 . . . 26-n. The plurality of detectors can also include a second type of detector of a fire condition, such as photoelectric-type smoke detectors 28-1, 28-2 . . . 28-n.

It will be understood that alternate forms of fire condition detectors including heat detectors, waterflow detectors or the like, could be incorporated into the system 10 without departing from the spirit and scope of the present invention.

The unit 12 also includes drive circuits 18*a*, coupled to processor 14. The drive circuits 18*a*, are in turn, coupled to a plurality of alarm output units 32 which could be visual fire alarm indicating strobe lights or audible bells, whistles or gongs, used to indicate the presence of a fire condition.

With respect to the detectors 26-1, 28-1; 26-2, 28-2 . . . 26-n, 28-n, it will be understood that such pairs of detectors could be carried within a common housing, or in separate housings located adjacent to one another.

Figure 2:
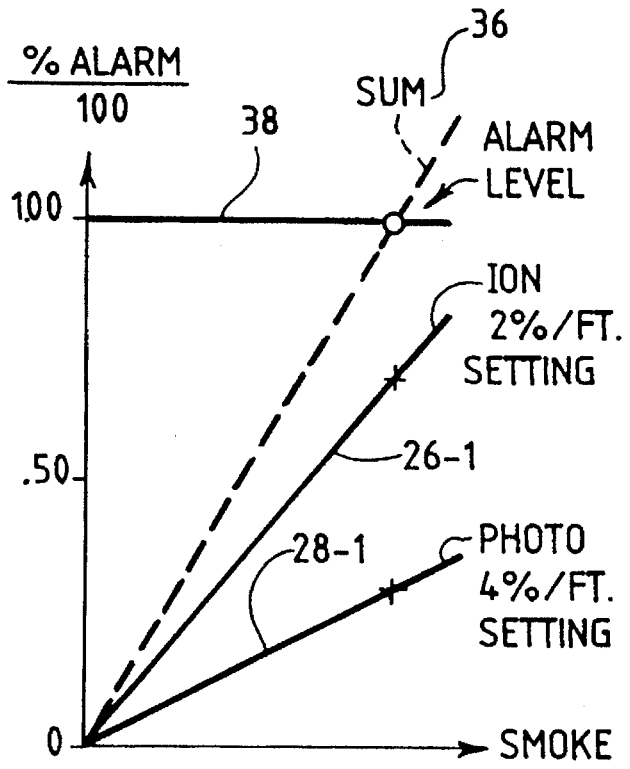
FIG. 2 is a graph of a pair of detectors responding to a fire, in accordance with the present invention.

FIG. 2 is a graph illustrating the response of a pair of detectors, 26-1 and 28-1 to a developing fire condition. The outputs of each of the detectors 26-1, 28-1, coupled via bi-directional link 20, are received and processed at program processor 14.

In one form of processing, and without limitation, the electrical signals indicative of levels of smoke detected at the detectors 26-1, 28-1 are added together in a summer or accumulator in processor 14. A comparator circuit in processor 14 compares that sum to a prestored, alarm threshold level indicated as 38 in FIG. 2.

When the sum 36 exceeds the value of the prestored threshold 38, which could be stored in RAM or ROM memory 16, the processor 14 is able to recognize the presence of a potential alarm condition. However, in accordance with the present invention, for purposes of minimizing false alarms, the alarm condition must be present and recognizable by the processor 14 for a time interval which takes into account the output values of each of the detectors 26-1, 28-1 and the associated sensitivity values. Equation 1 as set forth below defines how the interval of the delay is determined.

$$D = \text{delay} = \left( \frac{\%AL_P}{S_P} - \frac{\%AL_I}{S_I} \right) K \tag{1}$$

In Equation (1), the output of the two detectors, photoelectric-type and ion-type, are expressed as a percent of the alarm threshold 38. The sensitivity of each detector $S_P$, $S_I$, is expressed in compatible units. K is a constant as described below.

If the output $\%AL_P$ of detector 28-1, for illustrative purposes a photoelectric-type detector, divided by the sensitivity of that unit, $S_P$, is combined, by subtraction with the output of the detector 26-2, which could be an ionization-type detector, which is also divided by the sensitivity of the respective detector, a difference is formed which is directly proportional to the detector outputs and inversely proportional to the sensitivities thereof.

In accordance with the system 10 of FIG. 1, the processor 14 then multiplies the difference by a constant K to establish a delay interval. The constant can be selected from a plurality of constants stored in RAM or ROM 16. The selected constant is indicative of which of the two outputs from the detectors 26-1, 28-1 is greater as illustrated in Equation 2.

$$\text{If } \%AL_P > \%AL_I;\ K=40 \text{ (smoldering fire)}$$

$$\text{If } \%Al_I > \%AL_P;\ K=20 \text{ (flaming fire)} \tag{2}$$

By way of example, if the output of detector 26-1 in FIG. 2 corresponded to 0.7 units and the output of detector 28-1 corresponded to 0.3 units, the sum thereof would correspond to 1.0 units corresponding to the value of the alarm level 38. In such an instance, the processor 14 would then determine whether or not the alarm level 38 was met or exceeded by the sum for a delay interval as determined by Equation (1) above.

Using Equation (1), if the ionization-type detector 26-1 had been set at a sensitivity corresponding to two units and the photoelectric-type detector 28-1 had been set at a sensitivity corresponding to four units, since the output of the detector 26-1 exceeded that of the detector 28-1, a constant equal to 20 would be used by the processor 14 to produce a delay of 5.5 seconds as illustrated in Equation (3) which follows:

$$D = \left( \frac{.7}{2} - \frac{.3}{4} \right) *20 = 5.5 \text{ sec} \tag{3}$$

In contradistinction, and with respect to FIG. 2, as illustrated in Equation (4) subsequently, the determined delay due to a lower, different sensitivity setting of 0.5 units would have been on the order of 16 seconds:

$$D = \left( \frac{.7}{.5} - \frac{.3}{.5} \right) *20 = 16 \text{ sec} \tag{4}$$

When the processor 14 determines that the combined output values from the detectors 26-1, 28-1 exceed the alarm threshold level 38 for the determined delay interval, then the system 10 goes into alarm. In this instance, alarm indicator units 32 are energized via driver circuits 18*a* to provide both visual and audible indicators of an alarm condition.

As will be apparent from Equations (1) through (4) above, the determined time delay is very short when the detectors have a relatively low level of sensitivity. The time delay increases when the detectors are set to a relatively high level of sensitivity where both detectors are responding at the same time.

On the other hand, if only one detector of a pair, such as 26-1 is detecting a fire condition, but not the other, the delays will increase. For example, a flaming fire that is generating no large particles, may result in a longer delay than a flaming fire which is generating large particles. Similarly, a smoldering fire that is generating no small particles, will result in a longer delay than one which is in fact generating small particles.

Figure 3:
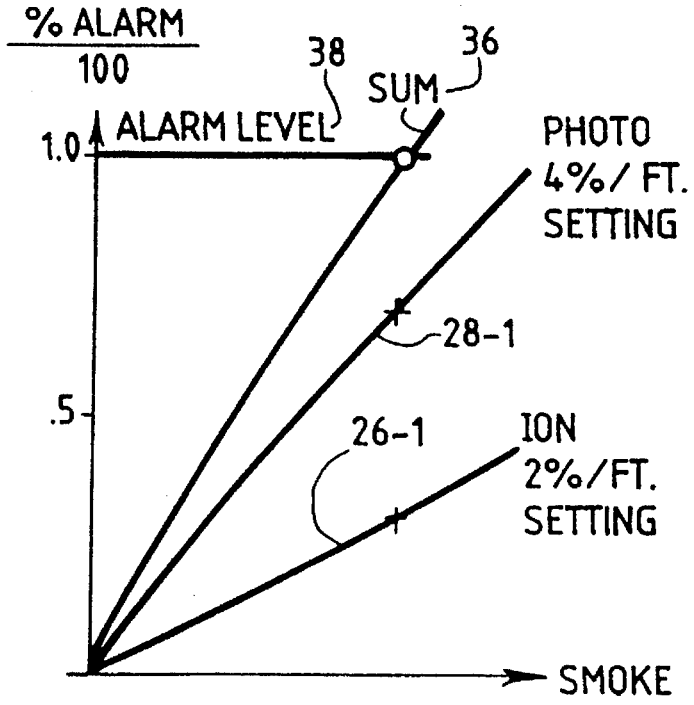
FIG. 3 is a graph of a pair of detectors responding to a different fire.

FIG. 3 is a graph which illustrates output of the system 10 where a photoelectric-type detector 28-1 is producing a significantly greater output than an associated ionization-type detector 26-1. In such an instance, Equations (5) and (6) subsequently illustrate respective delay intervals determined by the processor 14 in response to the same two different sets of sensitivities discussed above:

$$D = \left( \frac{.7}{4} - \frac{.3}{2} \right) *40 = 1.0 \text{ sec} \tag{5}$$

$$D = \left( \frac{.7}{.5} - \frac{.3}{.5} \right) *40 = 32 \text{ sec} \tag{6}$$

It will be understood in the event that the difference term in any of the above-noted equations is negative, that the value thereof will be set to zero resulting in zero delay in going into alarm.

Figure 4:
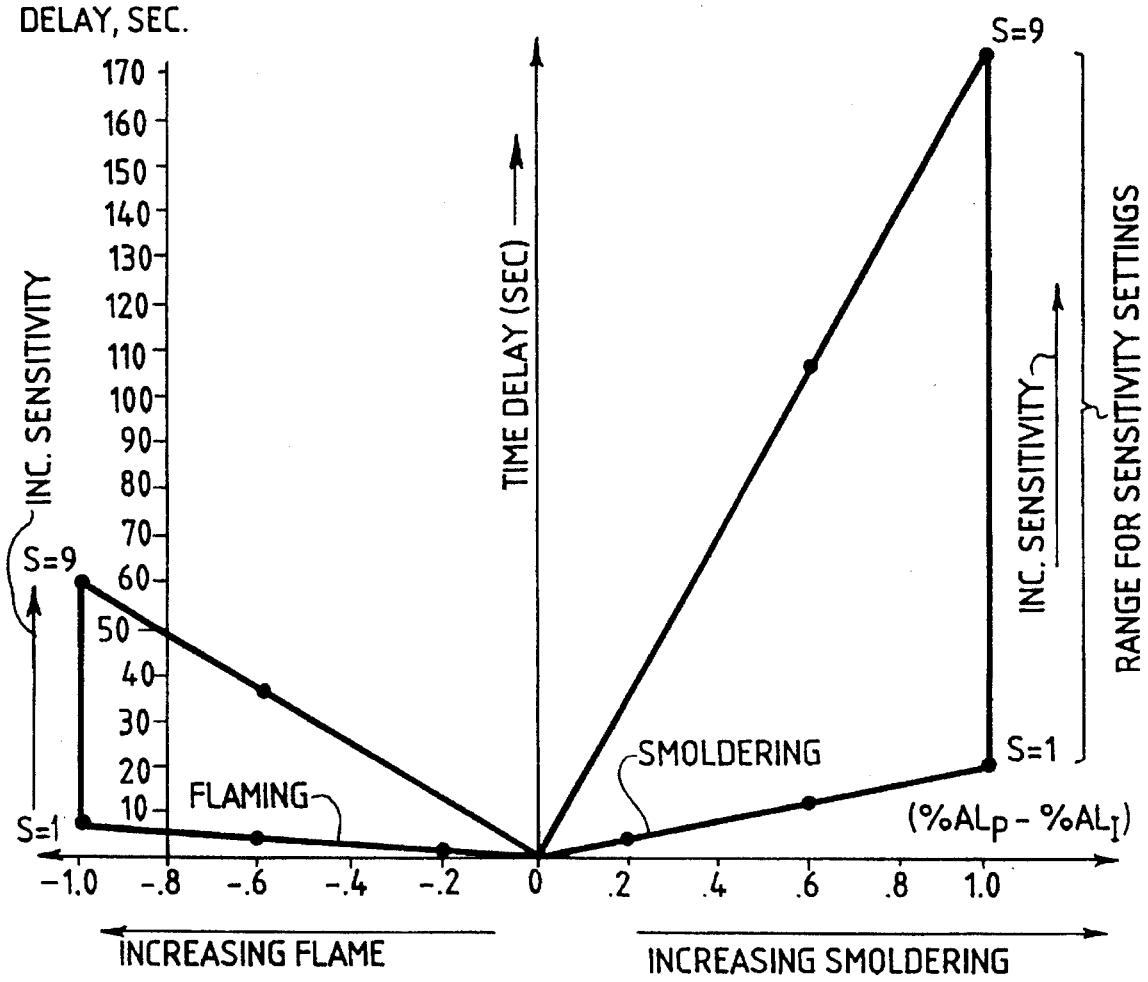
FIG. 4 is graph illustrating delay times as a function of various parameter.

FIG. 4 is a graph which illustrates variations in delay as a function of fire type as well as sensitivity for each of the detectors of a pair 26-1, 28-1. The graph of FIG. 4 corresponds to the following Equation (7) where the detectors of a pair, such as 26-1 and 28-1 each have the same sensitivity S:

$$D = (\% AL_P - \% AL_I)\frac{K}{S} \quad (7)$$

$K = 180$ if $\% AL_P > \% AL_I$
$K = 60$ if $\% AL_I > \% AL_P$

Figure 5:
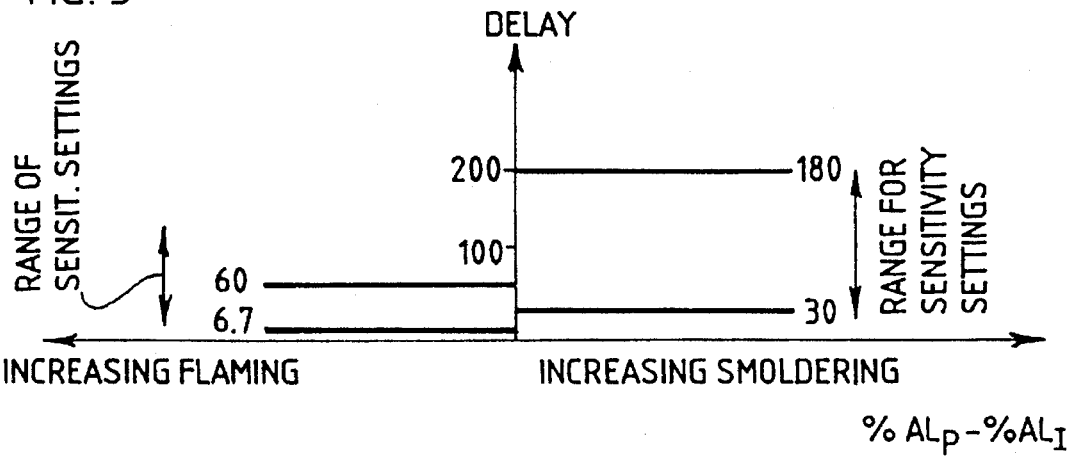
FIG. 5 is a graph illustrating delay for a particular combination of parameters.

FIG. 5 is a graph which illustrates a modification of Equation (7), represented by Equation (8) as set forth below:

$$D = K/S \quad (8)$$
$D = 180/S$ *if* $\% AL_P > \% AL_I$
$D = 60/S$ if $\% AL_I > \% AL_P$ As illustrated above, instead of forming a difference and using the value of that difference to determine a delay interval, as in Equation (4), one of the two delay values is chosen depending on which of the two detectors of the pair 26-1, 28-1 is producing the larger output signal. In such an event, for a given sensitivity S for the two detectors, the delay interval assumes one of two values dependent merely on which of the two detectors is generating a larger output value. The amplitude of the delay interval can be varied by varying the common sensitivity value of the two detectors as illustrated in FIG. 5.

Equation (1) can be modified to provide for improved performance by raising the output values for each of the types of detectors to a predetermined exponent as illustrated in the following equation:

$$\left(\frac{(\% AL_P^2)}{S_P} - \frac{(\% AL_I^2)}{S_I}\right)K = D \quad (9)$$

By raising each of the output values from the associated sensor to an exponential value, the magnitudes of each of the terms, $\%AL_P^2$ and $AL_I^2$ will be reduced for small values. This can then result in more rapidly increasing delays, depending on the relative magnitudes of the signals from each type of sensor, that is the case for delays determined in accordance with Equation (1). It will be understood that other exponential values can be used. Additionally, the exponential values need not be limited to integers.

It will be understood that the detector pairs 26-1, 28-1 could, but need not be implemented in a common housing. In such an event, the processing circuitry 14 could, if desired, be incorporated into that common housing and the detector pair could carry out the processing described above. In such an implementation, the detector pair 26-1, 28-1 could operate as a stand-alone unit. Alternately, they could communicate via the link 20 to a remote processor, such as the processor 14 which would in turn control the energizing of the fire alarm indicators 30.

As noted previously, a variety of fire detectors can be used without departing from the spirit and scope of the present invention. Other examples include, without limitation, heat, infrared or gas detectors.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A system for generating an alarm in response to at least first and second, different, sensed ambient conditions each indicative of a potential fire comprising:

at least one of a first type of sensor for generating a first signal corresponding to a first ambient condition indicative of a possible fire;

at least one of a second type of sensor for generating a second signal corresponding to a second ambient condition indicative of a possible fire; and a control circuit coupled to said sensors wherein said circuit includes processing circuitry, and wherein said processing circuitry combines said signals to produce an interval for delaying generation of an alarm by the system.

2. A system as in claim 1 wherein said processing circuitry includes circuitry for forming a difference between said signals.

3. A system as in claim 2 wherein said processing circuitry adjusts a magnitude of each said signal by a respective sensor parameter.

4. A system as in claim 2 wherein said processing circuitry includes means for adjusting each said signal magnitude by a parameter associated with said respective sensor.

5. A system as in claim 4 wherein said adjusting means includes a storage unit for storing a sensitivity parameter for each of said sensors.

6. A system as in claim 1 wherein said processing circuitry includes an arithmetic unit for forming a difference proportional to the magnitudes of said signals.

7. A system as in claim 1 wherein each of said sensors is carried within a housing.

8. A system as in claim 7 wherein said sensors are carried within a common housing.

9. A system as in claim 7 wherein said sensors are linked to said control circuit.

10. A system as in claim 9 wherein said control circuit includes alarm generation circuitry, wherein said processing circuitry is coupled to said alarm generation circuitry and wherein an alarm condition indicator signal is produced by said alarm generation circuitry where said signals from said sensors indicate an alarm condition for said interval.

11. A system as in claim 9 wherein said control circuit is displaced from said sensors and wherein said system includes a communication link wherein said sensors are in bidirectional communication with said control circuit via said link.

12. A system as in claim 11 wherein said control circuit includes a storage element for storing sensitivity parameter values for said sensors and wherein said processing circuitry establishes an alarm delay interval in response to values of said signals as well as said parameter values.

13. A system as in claim 12 wherein said delay is inversely proportional to said sensitivity parameter values.

14. A system as in claim 12 wherein said delay is directly proportional to said value of said signals.

15. A system as in claim 10 wherein said first type of sensor includes a photoelectric-type smoke sensor.

16. A system as in claim 10 wherein said first type of sensor includes an ionization-type smoke sensor.

17. A system as in claim 10 which includes an alarm output device coupled to said generation circuitry for producing at least an audible alarm output in response to said alarm condition indicator.

18. A system as in claim 10 wherein said first type of sensor includes a heat detector.

19. A system as in claim 1 wherein said control circuit includes further circuitry for adding said signals together to produce a sum and a comparator for comparing said sum to a reference value to determine the presence of an alarm condition and wherein said alarm condition must be present for at least said interval before an alarm can be generated.

20. A system as in claim 1, wherein said first and second ambient conditions are the same.

21. A method of minimizing false alarms in a fire detection system having a plurality of ambient condition detectors, the method comprising:

providing a fire detector of a first type;

providing a fire detector of a second type;

providing an alarm output device for generating at least an audible indication of a fire;

locating the detectors in a region to be monitored;

using the detectors to sense first and second fire related ambient conditions in the region;

generating an output from each detector wherein each respective output is indicative of a respective, sensed, ambient condition;

making the outputs available at a selected location;

processing the outputs by combining them in a first fashion so as to produce an alarm delay parameter in response to the sensed ambient conditions;

combining the outputs together in a second fashion to produce a fire condition indicator signal;

comparing the fire condition indicator signal to at least one threshold value to determine the existence of a fire condition; and energizing the output device in response to the presence of a determined fire condition for a period of time at least as long as the delay parameter.

22. A method as in claim 21 which includes, providing circuitry at the selected location for combining the outputs in the first fashion, by subtracting one from the other.

23. A method as in claim 21 which includes combining the outputs in the second fashion by adding them together.

24. A method as in claim 21 which includes raising the outputs to an exponential value before combining them in the first fashion.

* * * * *